United States Patent [19]

Manning

[11] 4,241,489

[45] Dec. 30, 1980

[54] METHOD OF REMOVING FASTENING ELEMENTS FROM WOVEN TAPE

[75] Inventor: Harry F. Manning, Meadville, Pa.

[73] Assignee: Textron Inc., Providence, R.I.

[21] Appl. No.: 40,792

[22] Filed: May 21, 1979

[51] Int. Cl.[3] ..... B23P 19/04; B26D 7/00

[52] U.S. Cl. ..... 29/408; 83/921

[58] Field of Search ..... 29/33.2, 408, 426, 427, 29/766, 770; 83/921

[56] References Cited

U.S. PATENT DOCUMENTS

| | | | |
|---|---|---|---|
| 2,838,112 | 6/1958 | Feitl | 83/921 X |
| 2,846,006 | 8/1958 | Feitl | 83/921 X |
| 3,540,090 | 11/1970 | Takamatsu | 29/408 X |
| 3,611,545 | 10/1971 | Takamatsu | 29/408 |
| 3,711,930 | 1/1973 | Potin | 29/408 |
| 3,831,474 | 8/1974 | Perlman | 83/921 X |
| 4,131,223 | 12/1978 | Aureli | 83/921 X |

*Primary Examiner*—Ervin M. Combs
*Attorney, Agent, or Firm*—O'Brien & Marks

[57] ABSTRACT

Gapping of slide fastener tapes is performed by cutting longitudinal connecting and supporting members carrying fastening elements on both sides of each element to be removed along perpendicular cutting lines. The fastening elements are then removed by pulling the fastening elements and the severed ends of the connecting and supporting members from between loops of weft threads which secure the connecting and supporting members in the inner edges of the tapes.

5 Claims, 7 Drawing Figures

METHOD OF REMOVING FASTENING ELEMENTS FROM WOVEN TAPE

TECHNICAL FIELD

The invention relates to methods of removing fastening elements from edges of tapes, and particularly, to removing elements which are mounted on longitudinal load-carrying support members such as cords, threads or the like secured to the edge of the tape by loops of weft thread passing over the support members between the fastening elements.

BACKGROUND ART

For woven slide fastener tapes having fastening elements molded onto longitudinal supporting cords or threads, the usual method of producing gaps employs severing only the head portions of the fastening elements leaving the leg portions still attached to the tape. These remaining severed leg portions are abrasive when brought into contact with skin, are difficult to sew through, and tend to become jammed in a slider during movement of the slider.

The prior art, as exemplified in U.S. Pat. Nos. 3,540,090, 3,611,545, 3,711,930 and 4,131,223, contains a number of processes and apparatus for gapping a slide fastener wherein the fastening elements are completely removed from the sections of slide fastener tapes being gapped. However, the prior art methods are employed in different types of slide fasteners other than the present woven type of slide fastener, and are unsuitable for employment in completely removing elements from sections of slide fastener tapes wherein the elements are mounted on longitudinal supporting members woven in the edges of the tapes.

SUMMARY OF THE INVENTION

The invention is summarized in a method of removing fastening elements from a slide fastener tape wherein the fastening elements are secured to an edge portion of the tape by pluralities of loops of weft thread segments of the tape passing around longitudinal connecting and supporting means joined with and extending between the respective adjoining pairs of the fastening elements, the method including the steps of cutting the connecting and supporting means along cutting lines substantially perpendicular to the tape and parallel to the weft thread segments on opposite sides of each of the fastening elements, the cutting lines extending from the inner edge of the tape and terminating before reaching any warp thread which is not joined directly with the fastening elements, and pulling the fastening elements and severed ends of the connecting and supporting means from between the weft thread segments.

An object of the invention is to develop a simple procedure for completely removing fastening elements from selected sections of slide fastener tapes which have their fastening elements mounted on longitudinal support members woven in the edges of the tapes.

Another object of the invention is to avoid damaging or cutting warp and weft threads in tapes during gapping when such threads are not directly connected with the fastening elements being removed.

One advantage of the invention is that only two steps, namely the cutting of interconnecting fastening element supporting members and pulling the elements and severed ends of the supporting members from the inner edge weft thread loops, are required to completely remove fastening elements from a selected section of a slide fastener tape.

One feature of the invention is that the fastening elements in gapped sections of slide fastener tape are completely removed reducing abrasion to skin, difficulty in sewing, and jamming of sliders which resulted from prior art gapping procedures for fastening elements molded on longitudinal supporting members which are woven in the edges of the tapes.

Other objects, advantages and features of the invention will be apparent from the following description of the preferred embodiment taken in conjunction with the accompanying drawings.

DESCRIPTION OF THE PREFERRED EMBODIMENT

Figure 1:
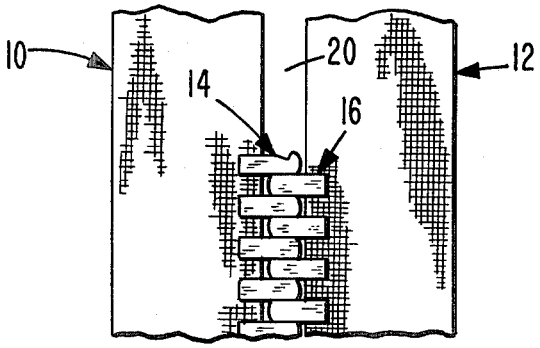
FIG. 1 is a plan view of a portion of a slide fastener having a gap formed in accordance with the invention.

As shown in FIG. 1, a slide fastener includes a pair of tapes indicated generally at 10 and 12 which have respective rows of fastening elements indicated generally at 14 and 16 secured to inner edges of the tapes wherein a gap 20 is formed in the rows of interlocking fastening elements. In the gap 20, the fastening elements 14 and 16 have been completely removed from the tapes 10 and 12. The tapes 10 and 12 with their associated fastening elements 14 and 16 are substantially mirror images of each other.

Figure 2:
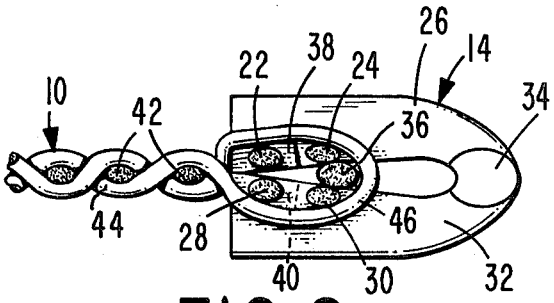
FIG. 2 is an enlarged cross-sectional view of a portion of one tape of the slide fastener of FIG. 1.

The fastening elements to be gapped in accordance with the invention are mounted on interconnecting and support means or members extending longitudinally in the edge of the tape. As shown for the elements 14 in FIGS. 2 and 3, this longitudinal interconnecting and supporting means includes a pair of spaced connecting threads 22 and 24 on which upper leg portions 26 of the elements 14 are molded and a pair of spaced connecting threads 28 and 30 on which lower leg portions 32 of the elements 14 are molded. The connecting threads 22, 24, 28 and 30 are embedded in the respective leg portions 26 and 32 adjacent their inner surfaces at the heel portions of the legs 26 and 32. The elements 14 have head portions 34 suitable for interlocking with head portions of the opposing elements 16. Additionally an invested cord 36 may be positioned between the leg portions 26 and 32 and there may be included projections 38 and 40 extending in opposite directions from the respective leg portions 26 and 32 along the threads 22 and 28 for overlapping projections of adjacent coupling elements to provide improved stability in the fastening elements and strength in the longitudinal connecting and supporting means.

The tape 10 has a plurality of longitudinal warp threads 42 and a weft thread 44 which is interwoven with the warp threads 42 and has segments 46 looped around the longitudinal connecting and supporting means between the elements 14 on the inner edge of the tape. There are a plurality of the segments 46 between each adjacent pair of the elements 14. The segments 46 wrapped around the connecting and supporting means for the elements 14 form the sole support or mounting of the elements 14 on the inner edges of the tape 10. Preferrably, the weft threads are untwisted multifilament threads, but the present process can also be used where the weft threads are twisted. None of the warp threads 42 are directly secured to the elements 14. Also, none of the warp threads 42 overlie the leg portions of the coupling elements 14.

Figure 3:
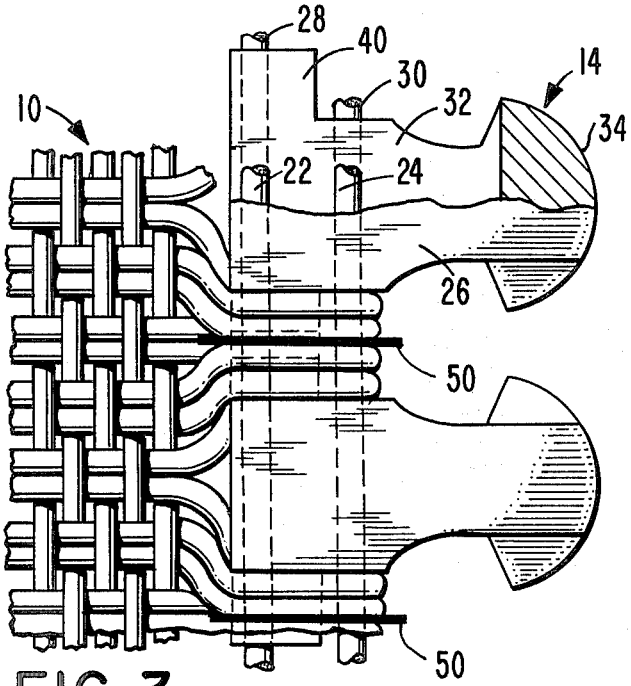
FIG. 3 is a plan view of the tape portion of FIG. 2.
Figure 4:
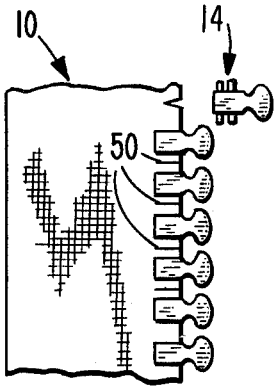
FIG. 4 is a plan view of one tape of the slide fastener of FIG. 1 illustrating one step in the forming of the gap.

To form the gap 20, a plurality of cuts illustrated by lines 50 in FIGS. 3 and 4 are formed in the inner edge of the tape 10, the cuts 50 extending perpendicular to the longitudinal dimension of the tape. One of the cuts 50 is formed on each side of each element 14 severing the longitudinal connecting and supporting means to its adjacent elements. The cuts 50 extend from the inner edge of the tape through the interconnecting and supporting means but do not extend to the first warp thread 42 to prevent cutting any of the warp threads 42. After the cuts 50 are formed, the elements 14 with their attached severed stubs of the interconnecting and supporting means are pulled from the edge of the tape 10.

In a demonstration of the process of the invention, the cuts 50 may be made by scissors and the elements 14 can be pulled one at a time by fingers from the edge of the tape 10.

Figure 5:
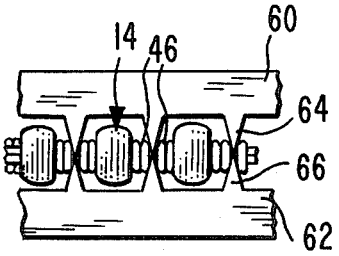
FIG. 5 is a side view of a slide fastener tape illustrating one procedure for cutting longitudinal interconnecting and supporting members for the fastening elements.

In FIG. 5, the cuts are performed by a pair of cutting die members 60 and 62 having respective pinch-type cutting members 64 and 66 pass between the weft thread segments 46 between adjacent coupling elements 14 from opposite sides of the tape and then engage to pinch and sever the connecting and supporting means between each pair of fastening elements.

Figure 6:
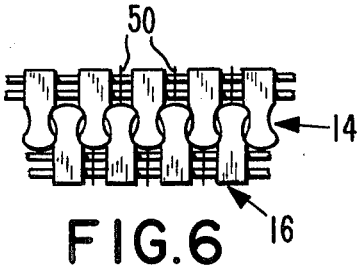
FIG. 6 is a plan view of a pair of trains of interlocking fastening elements interconnected by longitudinal support members wherein the weft and warp threads of the tapes have been removed and particularly illustrating a cutting step performed on a slide fastener with the elements in interlocking condition.

In FIG. 6, the coupling elements 14 and 16 are intermeshed and the cuts 50 are formed simultaneously in both of the connecting and supporting means for each of the elements 14 and 16. This cutting would be performed between the parallel weft loop segments (not shown in FIG. 6).

Figure 7:
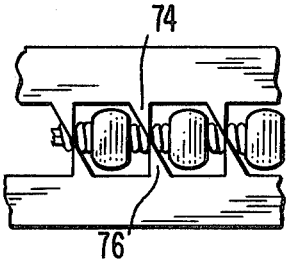
FIG. 7 is a view similar to FIG. 5 but illustrating a modified procedure for cutting interconnecting and supporting members.

A modification shown in FIG. 7 of the cutting is performed by shear type cutting members 74 and 76 mounted on respective die members for passing between weft thread segments from opposite sides of the tape and shearing the connecting and supporting means between each pair of adjacent fastening elements.

By performing the cutting along the lines 50 which extend perpendicular to the tape 10 and parallel to the weft thread segments 46, the cutting does not substantially damage the weft thread 44. Thus after the elements 14 are removed, the tape 14 does not have any tendency to unravel but remains a complete supporting member for the elements 14 not within the gap 20. This method of cutting the connecting and supporting means and removing the elements with the severed ends of the connecting and supporting means provides a simple and easily performed method for completely removing the elements 14 to form the gap 20. In prior art processes, the leg portions 26 and 32 of the elements were cut adjacent the inner edge of the tape to remove only the head portions 34 leaving the remaining portions of the legs 26 and 32 on the tapes 10. The present method has an advantage over the prior art process in that the coupling elements are completely removed in the gap 20 avoiding any abrasive portions of the elements remaining on the tapes 10 and 12 as well as eliminating problems with hang-up of the slider on the stubs, or with sewing across the gapped portion of the slide fastener.

Since the invention is subject to many variations, modifications and changes in detail, all matter described in the foregoing description and shown in the accompanying drawings is only illustrative and is not to be interpreted in a limiting sense.

What is claimed is:

1. A method of removing fastening elements from a slide fastener tape wherein the fastening elements are secured to an inner edge portion of the tape by pluralities of loops of weft thread segments of the tape passing around longitudinal connecting and supporting means joined with and extending between the respective adjoining pairs of the fastening elements, the method comprising the steps of cutting the connecting and supporting means along cutting lines substantially perpendicular to the tape and parallel to the weft thread segments on opposite sides of each of the fastening elements, the cutting lines extending from said inner edge portion of the tape and terminating before reaching any warp thread which is not joined directly with the fastening elements, and pulling the fastening elements and severed ends of the connecting and supporting means from between the weft thread segments.

2. A method as claimed in claim 1 wherein the cutting step includes passing a plurality of cutting members between weft thread segments on at least one side of the tape to sever the connecting and supporting means.

3. A method as claimed in claim 1 wherein the cutting step includes passing pairs of pinching cutting members between weft thread segments on opposite sides of the tape into the tape edge so that a pair of the pinching cutting members extend into the spaces between each of the fastening elements to be removed and the contiguous fastening elements, and engaging the pairs of pinching cutting members to sever the connecting and supporting means between each of the fastening elements.

4. A method as claimed in claim 1 wherein the cutting step includes passing pairs of shearing members between weft thread segments on opposite sides of the tape into the tape edge so that a pair of the shearing members extend into the space between each of the fastening element to be removed and the contiguous fastening element, and shearingly engaging the shearing members to sever the connecting and supporting means between each of the fastening elements.

5. A method as claimed in claim 1, 2, 3, or 4 wherein the connecting and supporting means includes a plurality of connecting threads embedded in leg portions of the fastening elements, and the cutting step includes the cutting of the connecting threads.

* * * * *